US010553335B1

(12) United States Patent
Hsu

(10) Patent No.: US 10,553,335 B1
(45) Date of Patent: Feb. 4, 2020

(54) VARISTOR MODULE

(71) Applicant: POWERTECH INDUSTRIAL CO., LTD., New Taipei (TW)

(72) Inventor: Jung-Hui Hsu, New Taipei (TW)

(73) Assignee: POWERTECH INDUSTRIAL CO., LTD., New Taipei (TW)

( * ) Notice: Subject to any disclaimer, the term of this patent is extended or adjusted under 35 U.S.C. 154(b) by 0 days.

(21) Appl. No.: 16/190,972

(22) Filed: Nov. 14, 2018

(30) Foreign Application Priority Data

Jul. 25, 2018 (TW) ..... 107125716 A

(51) Int. Cl.
*H01C 7/12* (2006.01)
*H01C 1/02* (2006.01)
*H01C 1/14* (2006.01)

(52) U.S. Cl.
CPC ..... *H01C 7/12* (2013.01); *H01C 1/02* (2013.01); *H01C 1/14* (2013.01)

(58) Field of Classification Search
CPC ..... H01C 7/12; H01C 1/02; H01C 1/14
See application file for complete search history.

(56) References Cited

U.S. PATENT DOCUMENTS 5,130,884 A * 7/1992 Allina ..... H01R 13/6666 361/117
8,378,778 B2 * 2/2013 Duval ..... H01C 7/126 338/20
2008/0293288 A1 * 11/2008 Caveney ..... H01R 4/2433 439/404
2009/0121822 A1 * 5/2009 Jeong ..... H01C 7/10 338/20
2014/0078634 A1 * 3/2014 Kampe ..... H01B 17/16 361/118
2015/0171622 A1 * 6/2015 Lee ..... H01C 7/126 361/93.7
2016/0111871 A1 * 4/2016 Ruess ..... H02H 5/04 361/118

* cited by examiner

*Primary Examiner* — Kyung S Lee
(74) *Attorney, Agent, or Firm* — Li & Cai Intellectual Property (USA) Office

(57) ABSTRACT

A varistor module includes a base, a case, and a varistor body. The base and the case are assembled with each other to form a closed space. The varistor body includes a plurality of ceramic chips and a bridging element. The ceramic chips are disposed in the closed space. Each ceramic chip has an electrode layer on two opposite sides, respectively. The bridging element has at least two bridging segments and a crossing segment. The bridging segments are connected to electrode layers of different ones of the ceramic chips. The crossing segment is disposed between the bridging segments.

13 Claims, 9 Drawing Sheets

VARISTOR MODULE

CROSS-REFERENCE TO RELATED PATENT APPLICATION

This application claims the benefit of priority to Taiwan Patent Application No. 107125716, filed on Jul. 25, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a varistor module, and more particularly to a varistor module for protecting electrical equipment from damage caused by transient surges.

BACKGROUND OF THE DISCLOSURE

Surge protection elements can be used to protect electrical equipment from damage caused by transient surges occurring in everyday life. Conventional surge protection elements may ignite when they are damaged, so that other protection elements are needed to prevent the conventional surge protection elements from catching fire. The conventional surge protection elements have relatively complicated components and structures. Further, conventional surge protection elements are disposed on circuit boards by traditional welding techniques. If the conventional surge protection elements are abnormal, they may reach high temperature and catch fire, and may also cause the circuit boards to catch fire. Therefore, the conventional surge protection elements are considered to have poor safety.

SUMMARY OF THE DISCLOSURE

In response to the above-referenced technical inadequacies, the present disclosure provides varistor module, which has a simplified structure.

In one aspect, the present disclosure provides a varistor module including a base, a case, and a varistor body. The case is assembled with the base to form a closed space. The varistor body includes a plurality of ceramic chips and a bridging element. The ceramic chips are disposed in the closed space. Each of the ceramic chips has two electrode layers on two sides, respectively. The bridging element has at least two bridging segments and a crossing segment disposed between the bridging segments. The bridging segments are connected to the electrode layers of different ones of the ceramic chips, respectively.

In certain embodiments, the bridging element further includes an extension segment extending from the bridging element and out of the closed space.

In certain embodiments, each of the bridging segments of the bridging element extends outward from the connected electrode layer along a planar direction of the ceramic chip, and the crossing segment of the bridging element stretches across along a thickness direction of the ceramic chips.

In certain embodiments, the crossing segment is embedded in the base.

In certain embodiments, at least one of the base and the case is made of a material containing ceramic.

In certain embodiments, at least one of the base and the case is made of a material containing glass fiber.

In certain embodiments, the extension segment extends from one of the bridging segment.

In certain embodiments, the bridging element further includes a puncture structure forming at the end of the extension segment, and the puncture structure is adapted for puncturing external wires to electrically connect the bridging segments with the external wires.

In certain embodiments, the extension segment of the bridging element, extending out of the closed space, is adapted for being engaged with an external electronic switch, so that power supplying to the bridging element and the electrode layers connected thereto is controlled by the external electronic switch.

In certain embodiments, the varistor module further includes at least one pin disposed on one of the electrode layers. The pin extends outward from the corresponding electrode layer and out of the closed space.

In certain embodiments, the medium in the closed space is air.

In one aspect, the present disclosure provides a varistor module including an oxidized metal base, an oxidized metal case, and a varistor body. The oxidized metal case is assembled with the oxidized metal base to form a closed space. The varistor body includes a circuit board, a plurality of ceramic chips, at least one pin, and at least one bridging foot. The circuit board is disposed in the closed space, having a bridge circuit. The ceramic chips are disposed on the circuit board. Each of the ceramic chips has an electrode layer on each of the two sides. The at least one pin passes through the circuit board and extends out of the oxidized metal base. One end of the bridging foot is connected to the electrode layer of the ceramic chip, and the other end of the bridging foot is connected to the bridge circuit of the circuit board.

In certain embodiments, the oxidized metal base is made of a material containing at least one of ceramic and glass fiber.

In certain embodiments, the oxidized metal case is made of a material containing at least one of ceramic and glass fiber.

In certain embodiments, the medium in the closed space is air.

Therefore, the bridging element of the present disclosure has at least two bridging segments and a crossing segment between the bridging segments. The bridging segments are connected to the different electrode layers of the ceramic chips, respectively, so as to reduce the number of pins and simplify structure.

Further, the pin of the present disclosure is made of metal, and is different from conventional wires. When the conventional varistors catch fire, wires having a low melting point may ignite and the fire may spread throughout the closed space due to the wires being welded on circuit boards. However, since the pin of the present disclosure extends out of the closed space, the present disclosure can prevent the above issue. Therefore, the varistor module of the present disclosure is much safer.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the detailed description and the accompanying drawings, in which.

DETAILED DESCRIPTION OF THE EXEMPLARY EMBODIMENTS

Figure 1:
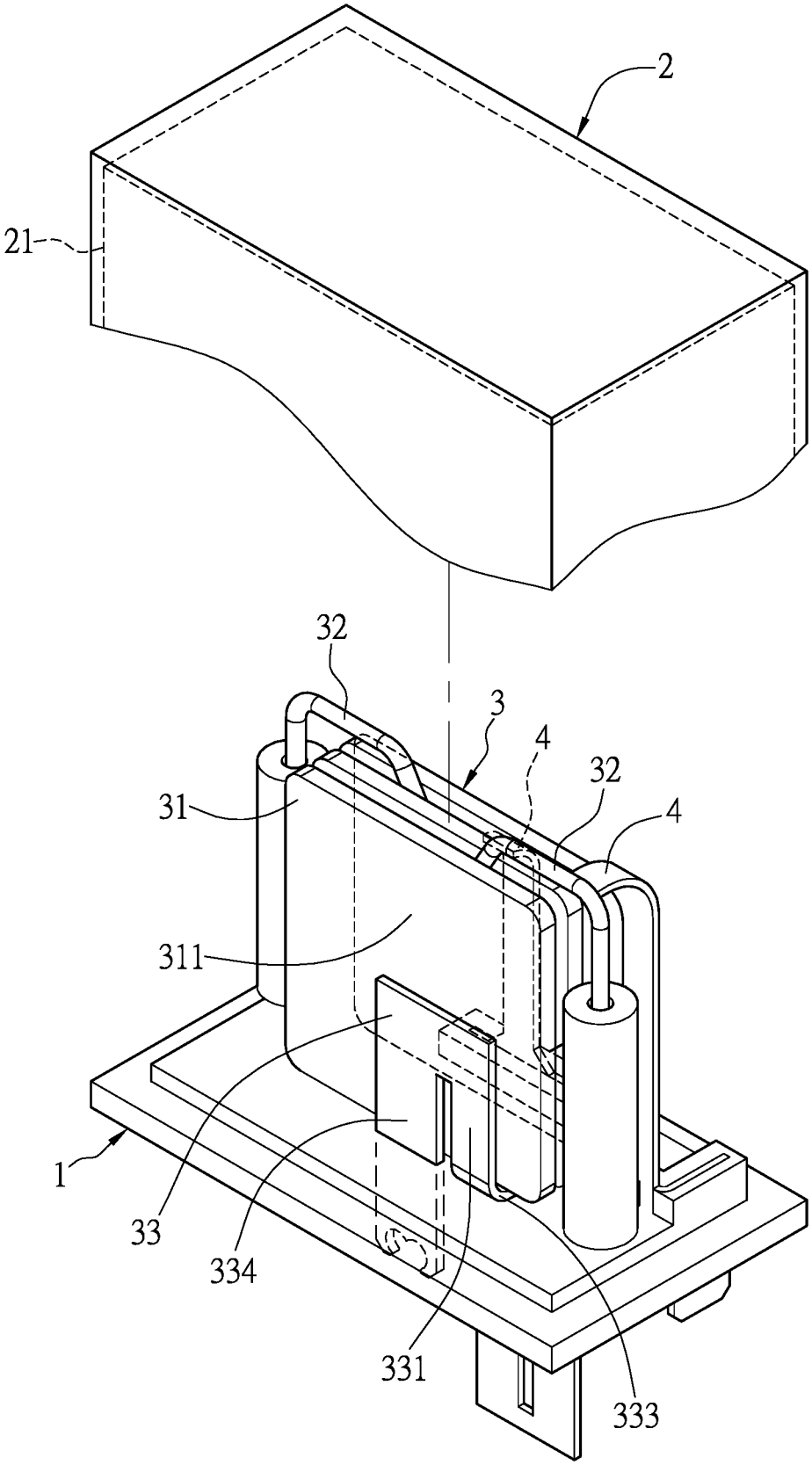
FIG. 1 is a perspective view showing a varistor module according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
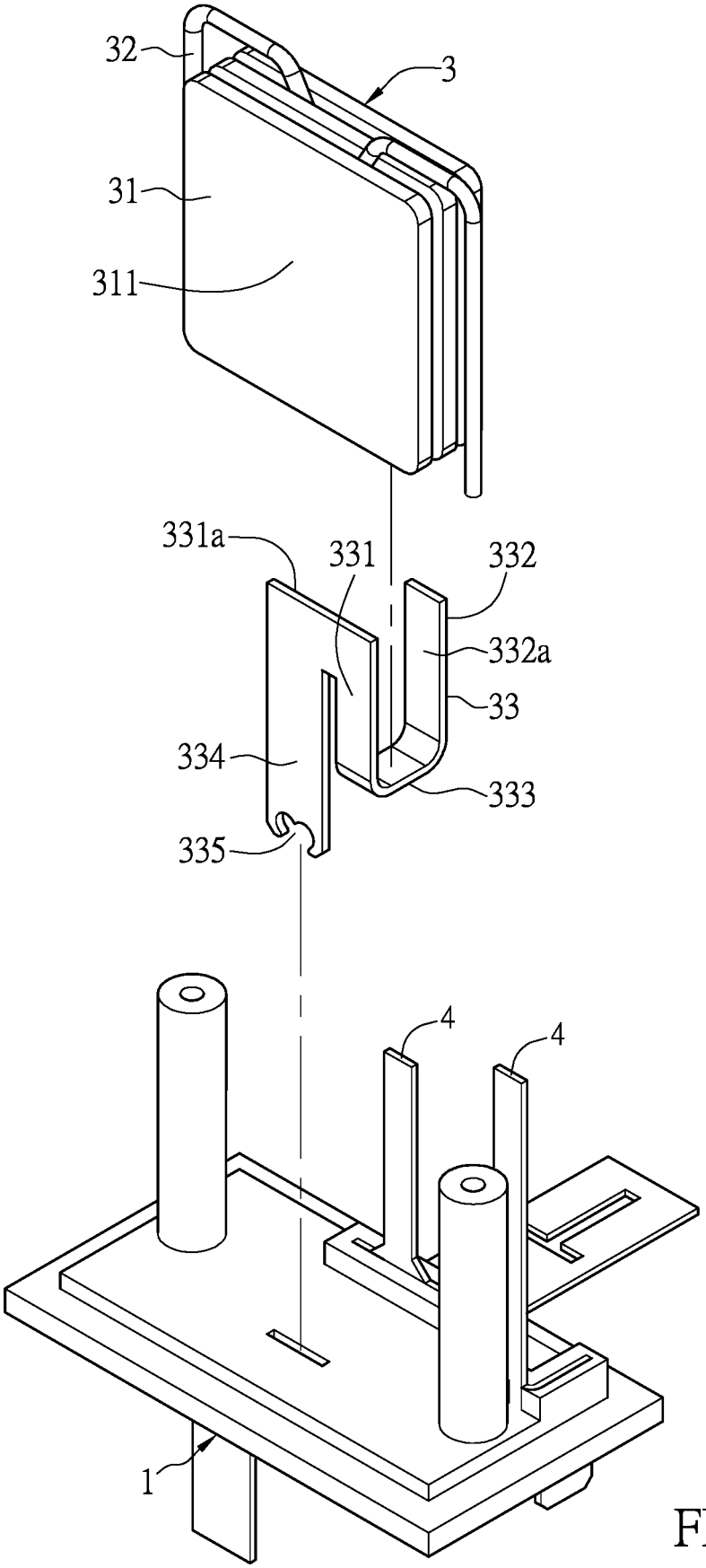
FIG. 2 is an exploded view showing the varistor module according to the first embodiment of the present disclosure.
Figure 3:
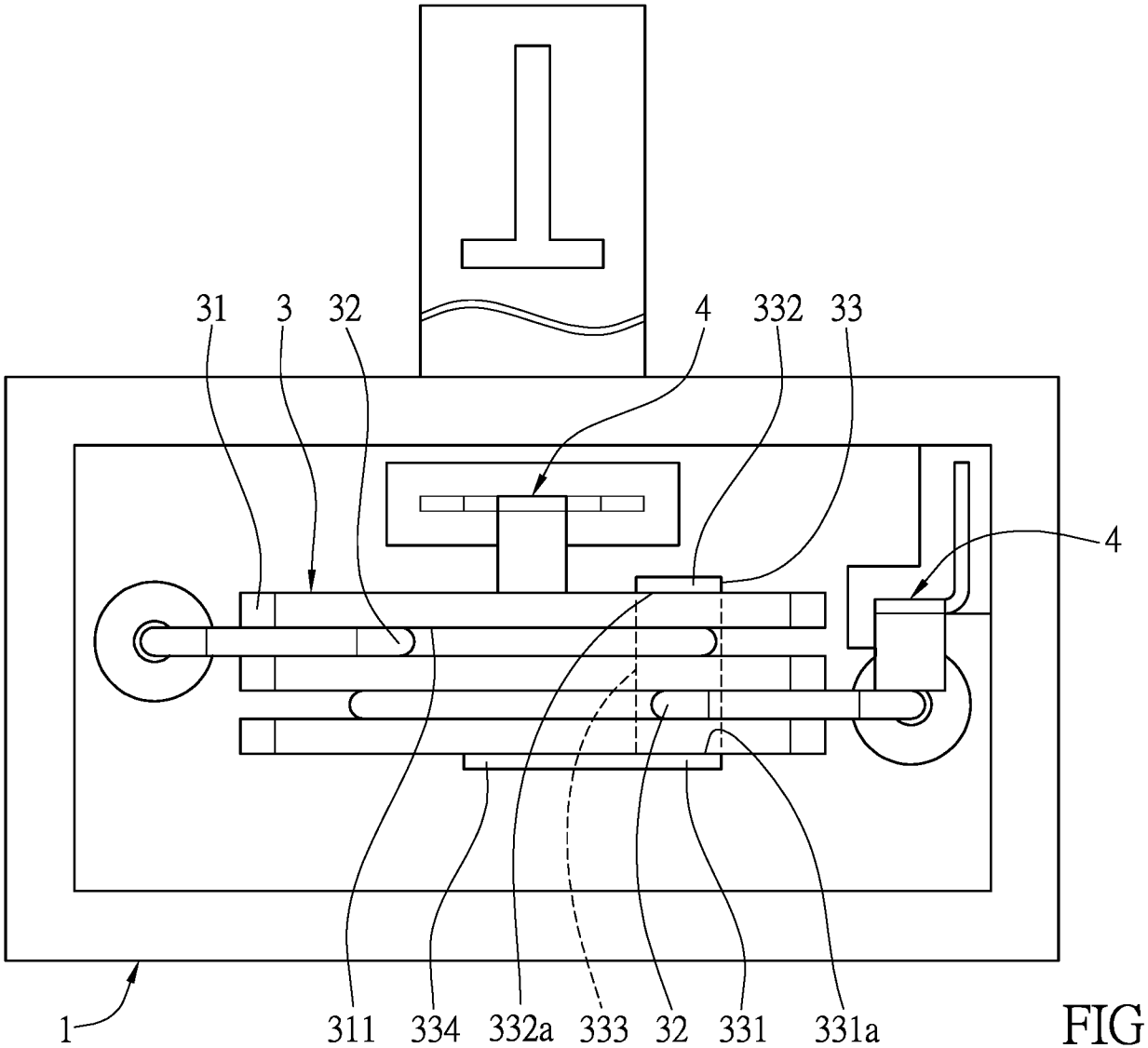
FIG. 3 is a top view showing the varistor module according to the first embodiment of the present disclosure.

Referring to FIG. 1 to FIG. 3, a first embodiment of the present disclosure provides a varistor module including a base 1, a case 2, and a varistor body 3. Preferably, the base 1 is made of a material containing ceramic or glass fiber. Preferably, the case 2 is made of a material containing ceramic or glass fiber, but is not limited thereto. At least one of the base 1 and the case 2 is made of a material containing ceramic or glass fiber. The case 2 can be a hollow body, and one end (lower end) of the case 2 is open. The base 1 and the case 2 are assembled together to form a closed space 21. The medium in the closed space 21 is air.

The varistor body 3 includes a plurality of ceramic chips 31, and a bridging element 33. The varistor body 3 can further include at least one pin 32. The ceramic chips 31 are disposed in the closed space 21, and each of the ceramic chips 31 has two electrode layers 311 on two sides, respectively. The pin 32 is made of a conductive material. The pin 32 is disposed on one of the electrode layer 311, and extends outward from the corresponding electrode layer 311 and out of the closed space 21. The pin 32 can be connected to one or two of the ceramic chips 31, but is not limited thereto. In the present embodiment, two pins 32 are connected to two of the ceramic chips 31, respectively, and extend outward from the corresponding electrode layers 311 and out of the closed space 21.

The bridging element 33 is made of a conductive material. The bridging element 33 has at least two bridging segments 331, 332, a crossing segment 333, and an extension segment 334. The bridging segments 331, 332 are connected to different ones of the electrode layers 311 of the ceramic chips 31, respectively. Portions of the bridging segments 331, 332 connecting to each of the electrode layers 311 are defined as connection surfaces 331*a*, 331*b*. The crossing segment 333 is disposed between the bridging segments 331, 332, and the crossing segment 333 can be embedded in the base 1. The extension segment 334 extends from one of the bridging segment 331 of the bridging element 33, and the extension segment 334 extends from the bridging element 33 and out of the closed space 21.

In the present embodiment, the bridging segments 331, 332 of the bridging element 33 extend outward from the corresponding electrode layer 311 and along a planar direction of the ceramic chips 31. The crossing segment 333 of the bridging element 33 stretches across along a thickness direction of the ceramic chips 31. The bridging element 33 can include a puncture structure 335 formed at the end of the extension segment 334, and the puncture structure 335 is adapted for puncturing external wires (not shown) to electrically connect the bridging segments 331 with the external wires.

The base 1 can be disposed with two metal flat springs 4 (protection devices), one end of the metal flat springs 4 extends out of the closed space 21, the other end of the metal flat springs 4 is welded with the electrode layer 311 and the pin 32 of the ceramic chip 31. When the varistor module is abnormal and reaches a high temperature, the low melting point solder starts to change from a solid state to a liquid state, and at this time the adhesion force of the solder connected to the ceramic chip 31, the pin 32, and the metal flat spring 4 also decreases. When the adhesion force is lower than the elastic force of deformation of the metal flat spring 4, the metal flat spring 4 is disconnected from the ceramic chip 31 and the limit pins 32, and reverts to the state before the deformation caused by the external force, so that the varistor module is in an open circuit state and is prevented from further generating heat so as to achieve a protective effect.

Second Embodiment

Figure 4:
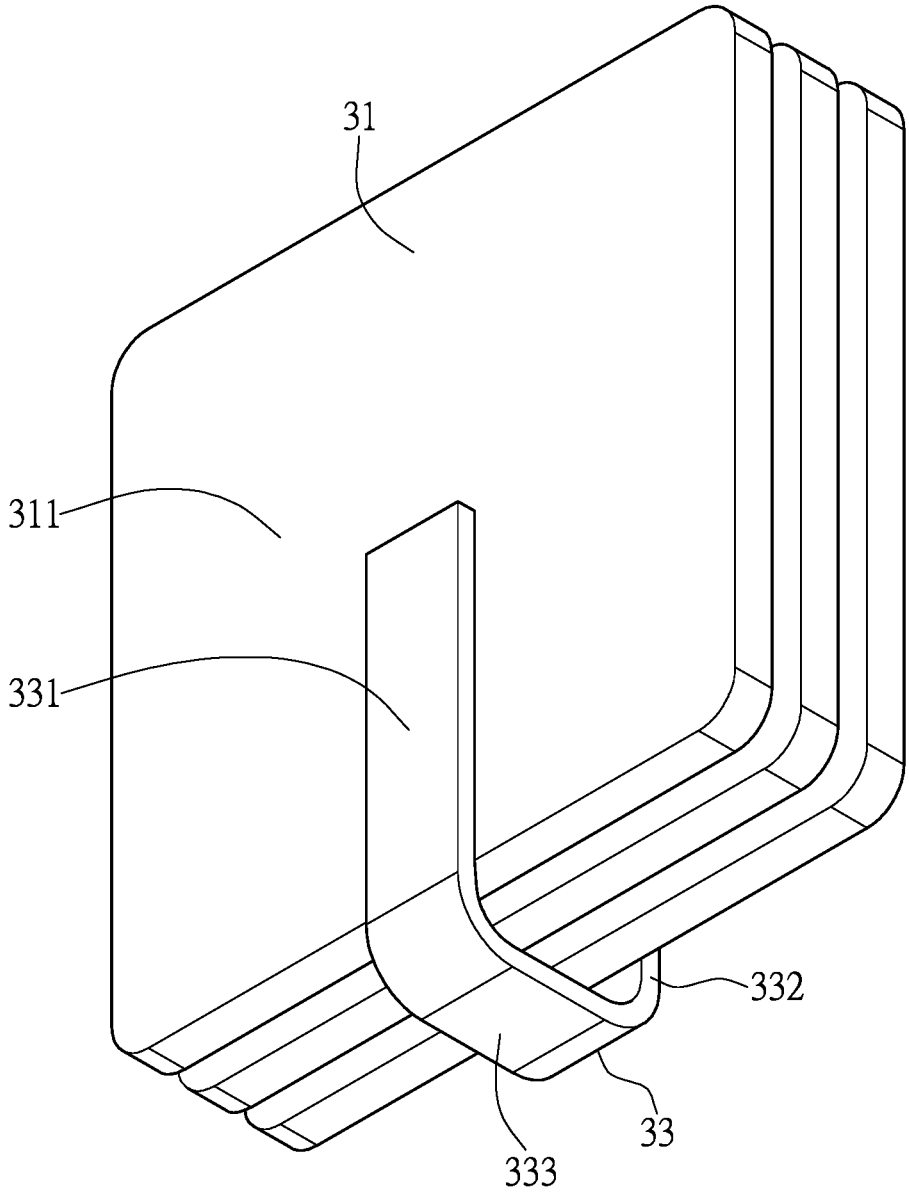
FIG. 4 is a perspective view showing a varistor body according to a second embodiment of the present disclosure.

Referring to FIG. 4, the present embodiment is roughly the same as the first embodiment, and the difference between the present embodiment and the first embodiment is that: the extension segment 334 in the first embodiment is omitted. The bridging element 33 has at least two bridging segments 331, 332 and a crossing segment 333 disposed between the bridging segments 331, 332. The bridging segments 331, 332 are connected to different ones of the electrode layers 311 of the ceramic chips 31, respectively. The crossing segments 333 are between the bridging segments 331, 332, stretching across the ceramic chips 31.

Third Embodiment

Figure 5:
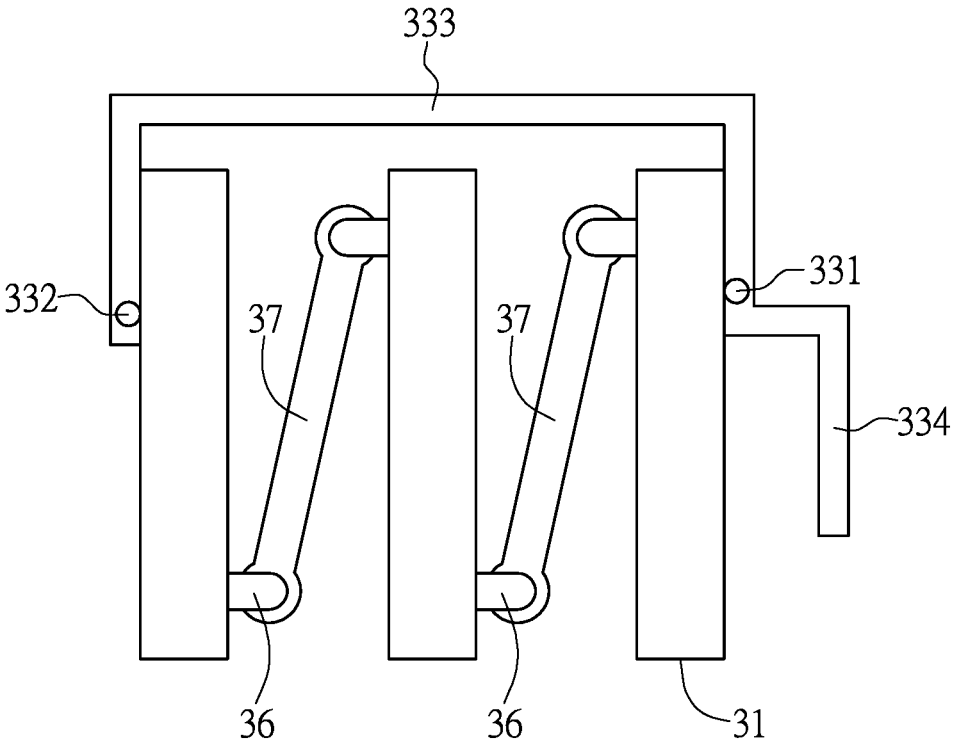
FIG. 5 is a top view showing a varistor module according to a third embodiment of the present disclosure.

Referring to FIG. 5, the present embodiment is roughly the same as the first embodiment, and the difference between the present embodiment and the first embodiment is that a bridging circuit and a bridging foot are used to replace the bridging element. Specifically, the varistor module of the present embodiment has a circuit board, and the circuit board has the bridging circuit that is the equivalent of the crossing segment 333. One of the ceramic chips 31 has a bridging foot that is the equivalent of the bridging segment 331, and another one of the ceramic chips 31 has another bridging foot that is the equivalent of the bridging segment 332. Two non-adjacent ceramic chips 31 are disposed on the circuit board through the bridging foots (bridging segments 331, 332). The bridging circuit that is the equivalent of the crossing segment 333 is electrically connected to the bridging foots (bridging segment 331, 332). Further, two pins 36 are electrically connected with each other by a copper foil 37 on the circuit board. In one implementation, two adjacent ceramic chips 31 of the present embodiment share one pin 32 (shown in FIG. 5). Further, aside from extending outward from the electrode layers 311 of the ceramic chip 31, the pins 36 can also be added from the bridging circuit of the circuit board.

Further, in the present embodiment, the varistor includes a base 1, a case 2, and a varistor body 3. The base 1 is an oxidized metal base. The case 2 is an oxidized metal case. The oxidized metal base and the oxidized metal case are made of a material containing ceramic or glass fiber In other words, the oxidized metal base or the oxidized metal case is made of ceramic or glass fiber. The base 1 and the case 2 are assembled with each other to form a closed space 21. The varistor body 3 includes a circuit board, a plurality of ceramic chips 31, two pins 36, and two bridging foots. The circuit board is disposed in the closed space 21, and the circuit board has a bridging circuit. The ceramic chips 31 are disposed on the circuit board, and each of the ceramic chips 31 has two electrode layers 311 on two sides, respectively. The pins 36 are disposed on the electrode layers 311, respectively. The pins 36 extend outward from the corresponding electrode layer 311, and pass through the circuit board and extend out of the oxidized metal base. One end of the bridging foot is connected to the electrode layer 311 of the ceramic chip 31, and the other end of the bridging foot is connected to the bridge circuit of the circuit board (as shown in FIG. 5). In the present embodiment, the pins 36 of different varistor body 3 are electrically connected with each other through the bridging circuit of the circuit board to form a parallel loop. Furthermore, the circuit board can bridge wires or terminals and extend outside of the case 2.

Fourth Embodiment

Figure 6:
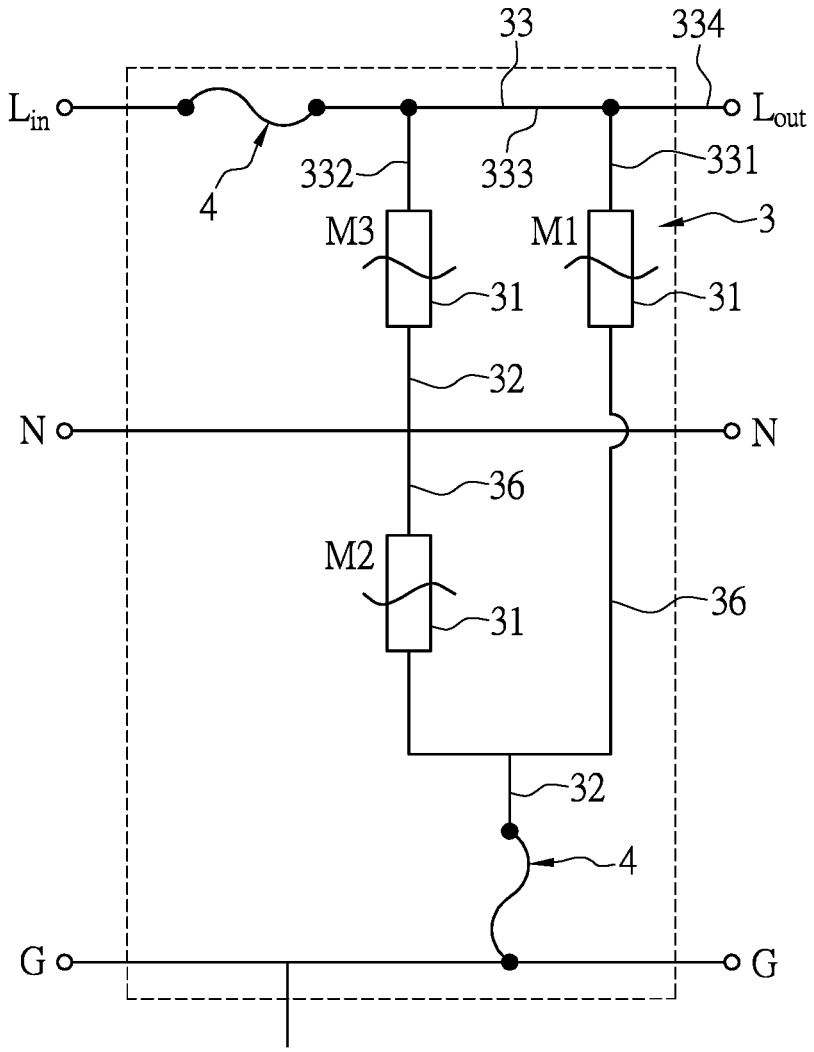
FIG. 6 is a circuit diagram showing a varistor module according to a fourth embodiment of the present disclosure.
Figure 7:
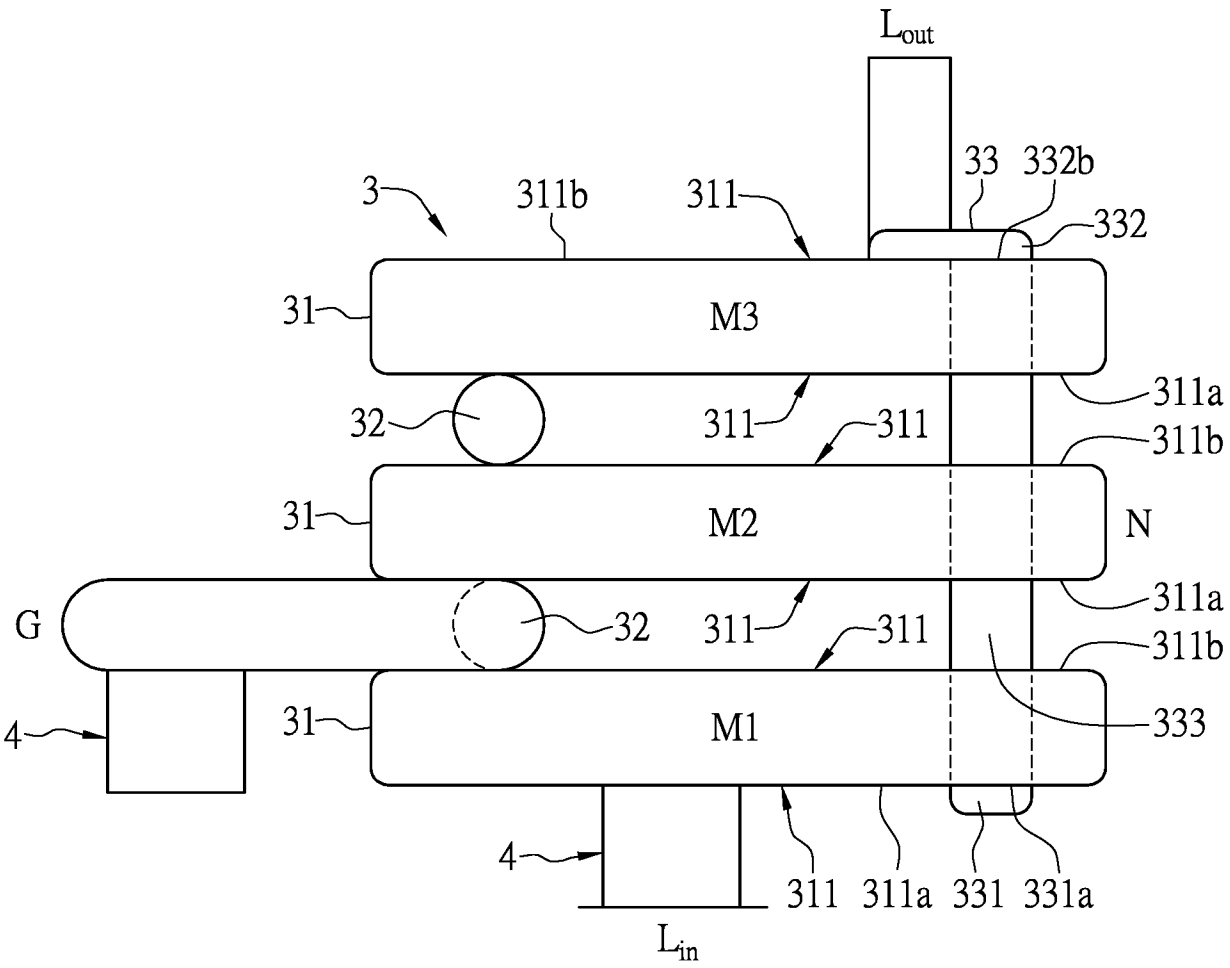
FIG. 7 is a top view showing a varistor module according to the fourth embodiment of the present disclosure.

Referring to FIG. 6 and FIG. 7, the present embodiment provides a method for using three-hole socket to protect L-N/L-G/N-G, and the three-hole household AC power plug and socket contain a live line L, a neutral line N, and a ground line G The present embodiment illustrates the connection relationship between the three-hole household AC power plug and socket. The present embodiment is roughly the same as the forgoing embodiments, and the difference is that the varistor body 3 includes three ceramic chips 31 and a bridging element 33. The bridging segments 331, 332 of the bridging element 33 are used to connect the electrode layers 311 of the two ceramic chips 31 (M1, M3), which are a first electrode surface 311*a* of the ceramic chip M1 and a second electrode surface 311*b* of the ceramic chip M3. The varistor body 3 includes two pins 32. One of the pins 32 is used to connect the electrode layers 311 of the two ceramic chip 31 (M1, M2), which are a second electrode surface 311*b* of the ceramic chip M1 and a first electrode surface 311*a* of the ceramic chip M2. The other one of the pins 32 is used to connect the electrode layers 311 of the two ceramic chip 31 (M2, M3), which are a second electrode surface 311*b* of the ceramic chip M2 and a first electrode surface 311*a* of the ceramic chip M3. The varistor module of the present embodiment further includes two metal flat springs 4 to serve as protection devices. One end of the metal flat springs 4 extends out of the closed space 21, and the other end of the metal flat springs 4 is welded on one of the electrode layers 311 and one of the pins 32 of the ceramic chips 31, respectively, so as to achieve a protective effect. FIG. 7 is a schematic view, and the pins 32 and the bridging element 33 of the present disclosure are not limit to specific shapes or types, which can be exemplified as a strip or a column, and profiles thereof can be exemplified as being square, round or oval. Furthermore, FIG. 5 schematically illustrating the third embodiment can be read in conjunction with FIG. 6 illustrating the circuitry of the present embodiment, so as to have better understanding of the third embodiment.

Fifth Embodiment

Figure 8:
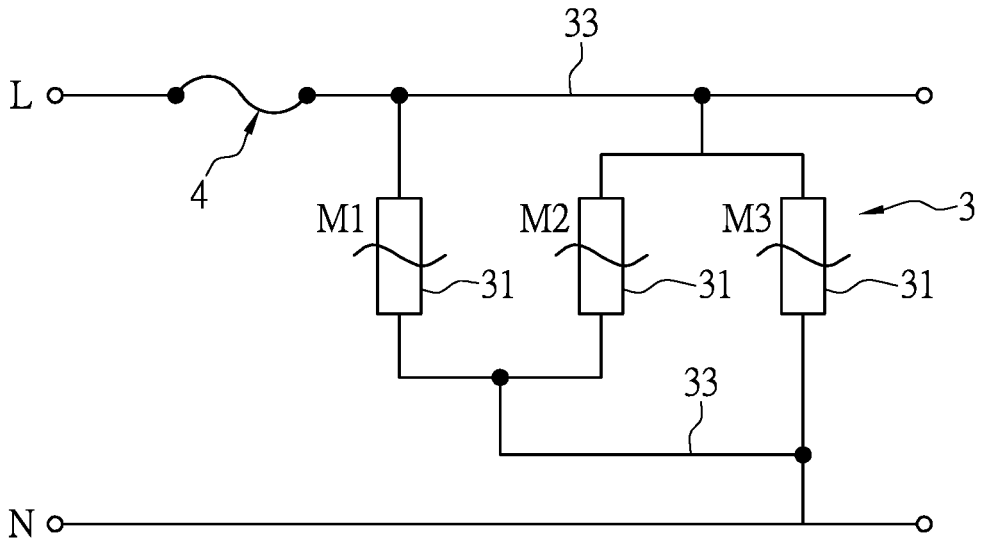
FIG. 8 is a circuit diagram showing a varistor module according to a fifth embodiment of the present disclosure.
Figure 9:
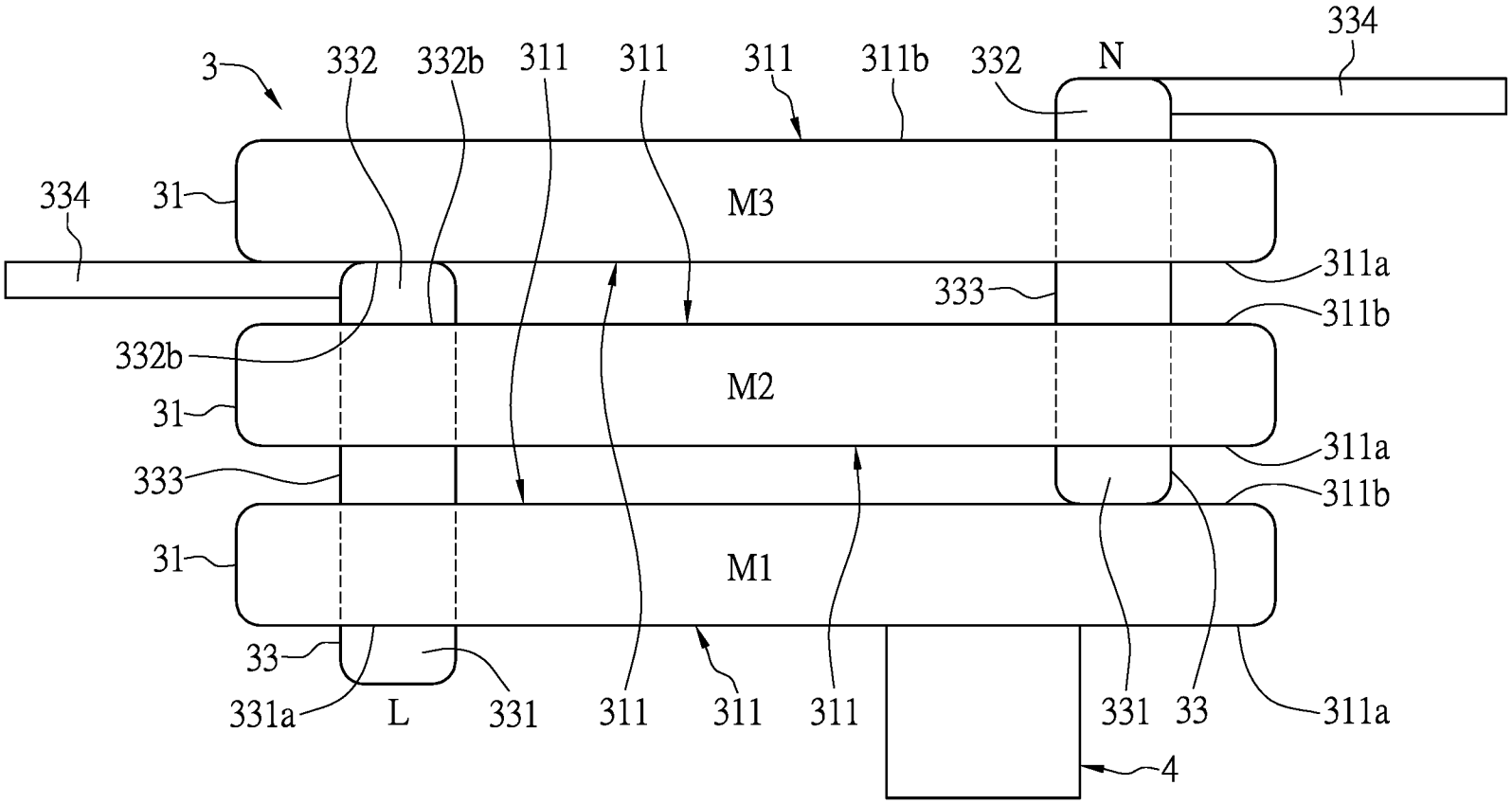
FIG. 9 is a top view showing the varistor module according to the fifth embodiment of the present disclosure.

Referring to FIG. 8 and FIG. 9, the present embodiment provides a method for protecting two-phase L/N. The present embodiment is roughly the same as the forgoing embodiments, and the difference is that the varistor body 3 includes three ceramic chips 31 and two bridging element 33. One of the bridging elements 33 is connected to the first electrode surface 311*a* of the ceramic chip M1 with the bridging segment 331, and the bridging segment 332 is connected to the second electrode surface 311*b* of the ceramic chip M2 and the first electrode surface 311*a* of the ceramic chip M3. The other one of the bridging elements 33 is connected to the second electrode surface 311*b* of the ceramic chip M1 and the first electrode surface 311*a* of the ceramic chip M2 with the bridging segment 331, and the bridging segment 332 is connected to the second electrode surface 311*b* of the ceramic chip M3. The varistor module of the present embodiment further includes the metal flat spring 4 regarding as the protection device. One end of the metal flat spring 4 extends out of the closed space 21, and the other end of the metal flat spring 4 is welded on one of the electrode layers 311 of the ceramic chips 31.

Therefore, the bridging element 33 of the present disclosure has at least two bridging segments 331, 332 and a crossing segment 333 between the bridging segments 331 and 332. The bridging segments 331 and 332 are connected to the different electrode layers 311 of the ceramic chips 31, respectively, so as to reduce the number of the pins 32 and simplify structure.

Further, the pin 32 of the present disclosure is made of metal, and is different from conventional wires. Since the pin 32 extends out of the closed space, it can avoid catching fire like conventional wires being welded on circuit boards. When conventional varistors catch fire, the fire may spread to the outside of the closed space along low melting point wires. Therefore, based on the above, the varistor module of the present disclosure is much safer.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A varistor module, comprising:

a base;

a case assembled with the base to jointly form a closed space, wherein the medium in the closed space is air; and a varistor body including a plurality of ceramic chips disposed in the closed space, each of the ceramic chips having electrode layers on two sides, respectively;

a bridging element having at least two bridging segments and a crossing segment disposed between the bridging segments, the bridging segments connected to the electrode layers of different ones of the ceramic chips, respectively.

2. The varistor module according to claim 1, wherein the bridging element further includes an extension segment extending from the bridging element and out of the closed space.

3. The varistor module according to claim 1, wherein each of the bridging segments of the bridging element extends outward from the connected electrode layer along a planar direction of the ceramic chip, and the crossing segment of the bridging element stretches along a thickness direction of the ceramic chips.

4. The varistor module according to claim 1, wherein the crossing segment is embedded in the base.

5. The varistor module according to claim 1, wherein at least one of the base and the case is made of a material containing ceramic.

6. The varistor module according to claim 1, wherein at least one of the base and the case is made of a material containing glass fiber.

7. The varistor module according to claim 2, wherein the extension segment extends from one of the bridging segment.

8. The varistor module according to claim 2, wherein the bridging element further includes a puncture structure formed at the end of the extension segment, and the puncture structure is adapted for puncturing external wires to electrically connect the bridging segments with the external wires.

9. The varistor module according to claim 1, further comprising at least one pin disposed on one of the electrode layers, and the pin extends outward from the corresponding electrode layer and out of the closed space.

10. A varistor module, comprising:

an oxidized metal base;

an oxidized metal case assembled with the oxidized metal base to form a closed space; and a varistor body including a circuit board disposed in the closed space, and having a bridge circuit;

a plurality of ceramic chips disposed on the circuit board, each of the ceramic chips having an electrode layer on each of the two sides;

at least one pin passing through the circuit board and extending out of the oxidized metal base; and at least one bridging foot, one end of the bridging foot connected to the electrode layer of the ceramic chip, and the other end of the bridging foot connected to the bridge circuit of the circuit board.

11. The varistor module according to claim 10, wherein the oxidized metal base is made of a material containing at least one of ceramic and glass fiber.

12. The varistor module according to claim 10, wherein the oxidized metal case is made of a material containing at least one of ceramic and glass fiber.

13. The varistor module according to claim 10, wherein the medium in the closed space is air.

* * * * *